United States Patent [19]

Wirkus

[11] Patent Number: 5,037,325

[45] Date of Patent: Aug. 6, 1991

[54] PANEL MOUNTED ELECTRICAL CONNECTOR

[75] Inventor: Robert Wirkus, Bloomingdale, Ill.

[73] Assignee: Molex Incorporated, Lisle, Ill.

[21] Appl. No.: 594,491

[22] Filed: Oct. 5, 1990

[51] Int. Cl.[5] ..... H01R 13/58; H01R 13/74

[52] U.S. Cl. ..... 439/467; 439/557

[58] Field of Search ..... 439/557, 467, 465, 466, 439/558

[56] References Cited

U.S. PATENT DOCUMENTS 2,424,757 7/1947 Klumpp, Jr. ..... 439/557
4,413,872 11/1983 Rudy, Jr. et al. ..... 439/467
4,460,234 7/1984 Bogese ..... 439/557
4,560,227 12/1985 Bukala ..... 439/557
4,653,835 3/1987 Schulte et al. ..... 439/557

*Primary Examiner*—Gary F. Paumen
*Attorney, Agent, or Firm*—Louis A. Hecht; Stephen Z. Weiss; Charles S. Cohen

[57] ABSTRACT

An electrical connector for mounting in an opening in a panel is provided with a housing positionable in the panel opening. At least one latch arm is molded integrally with the housing for engaging the panel at an edge of the opening for securing the housing in the opening. The latch arm has a stepped configuration for accommodating panels of different thicknesses at the opening.

2 Claims, 2 Drawing Sheets

PANEL MOUNTED ELECTRICAL CONNECTOR

FIELD OF THE INVENTION

This invention generally relates to the art of electrical connectors and, particularly, to a panel mounted electrical connector which can accommodate panels of different thicknesses.

BACKGROUND OF THE INVENTION

Panel mounted connectors are known wherein a first connector is mounted in an opening in a panel for mating with a complementary connector, through the panel. The panel mounted connector can be either a receptacle connector or a mating plug connector. Often, such panel mounted connectors are sealed to or within the opening in the panel to seal the environment on one side of the panel from that on the other side of the panel and to seal the interconnection between the mating connectors.

An example of an application of panel mounted connectors is in the refrigeration industry, for example in appliances such as refrigerators and freezers. One side of a panel mounted connector will protrude through an opening in an appliance panel into the interior insulation. During manufacture, that side of the connector will be exposed to chemicals used to form the insulating foam. Before the foaming chemicals cure into dry insulation, they can contaminate the metal in the connector terminals resulting in incomplete electrical connections. Therefore, the connector itself is sealed, and the connector is sealed to the panel about the opening in which the connector is disposed. Usually, a gasket is positioned about the opening, sandwiched between the connector and the panel, and latch means are provided to securely hold the connector in the opening, in tight engagement with the gasket, to prevent any foaming chemicals from seeping around the connector and/or through the panel opening.

Because of known effectiveness, the latch means for such a panel mounted connector often is operative with or against the edge of the opening in the panel and latchable against an outside surface of the panel to secure the connector tightly within the opening. One of the problems with such panel mounted connectors is that the panel thickness may very. For efficiency and cost effectiveness, it is desirable to fabricate the latch means integral with the housing of the panel mounted connector. However, the latch means thereby becomes "married" to the connector and different connectors must be used for different thicknesses of panels. An alternative would be to use different latches operatively associated with a commonly constructed connector to accommodate panels of different thicknesses. However, this requires an inventory of different latches, and manufacturing and supplying different latches is not very cost effective.

This invention is directed to solving the above problems and satisfying the need of providing a panel mounted connector which has common latch means for accommodating panels of different thicknesses at the opening in the panel.

SUMMARY OF THE INVENTION

An object, therefore, of the invention is to provide a new and improved panel mounted electrical connector which is capable of mounting and latching in an opening in a panel and for accommodating panels of different thicknesses at the opening.

In the exemplary embodiment of the invention, generally, an electrical connector is provided with a housing positionable in an opening in a panel. At least one latch arm is provided on the housing for engaging the panel at an edge of the opening for securing the housing in the opening. The latch arm includes means for accommodating panels of different thicknesses at the opening.

As disclosed herein, a pair of latch arms are provided, one arm on each of two opposite sides of the housing. The latch arms are molded integrally with the housing in a cantilevered fashion and joined to the housing by integral "living" hinge means. The housing includes peripheral flange means for abutting one side of the panel about the opening, and the latch arms each have a stepped configuration for engaging the opposite side of the panel, the steps on the latch arm presenting different abutment surfaces to accommodate panels of different thicknesses, as the abutment flange engages one side of the panel and the stepped surface(s) engage the other side of the panel, thereby securing the connector in the panel opening.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the following description taken in conjunction with the accompanying drawings, in which like reference numerals identify like elements in the figures and in which:

DETAILED DESCRIPTION OF THE PREFERRED EMBODIMENT

Figure 1:
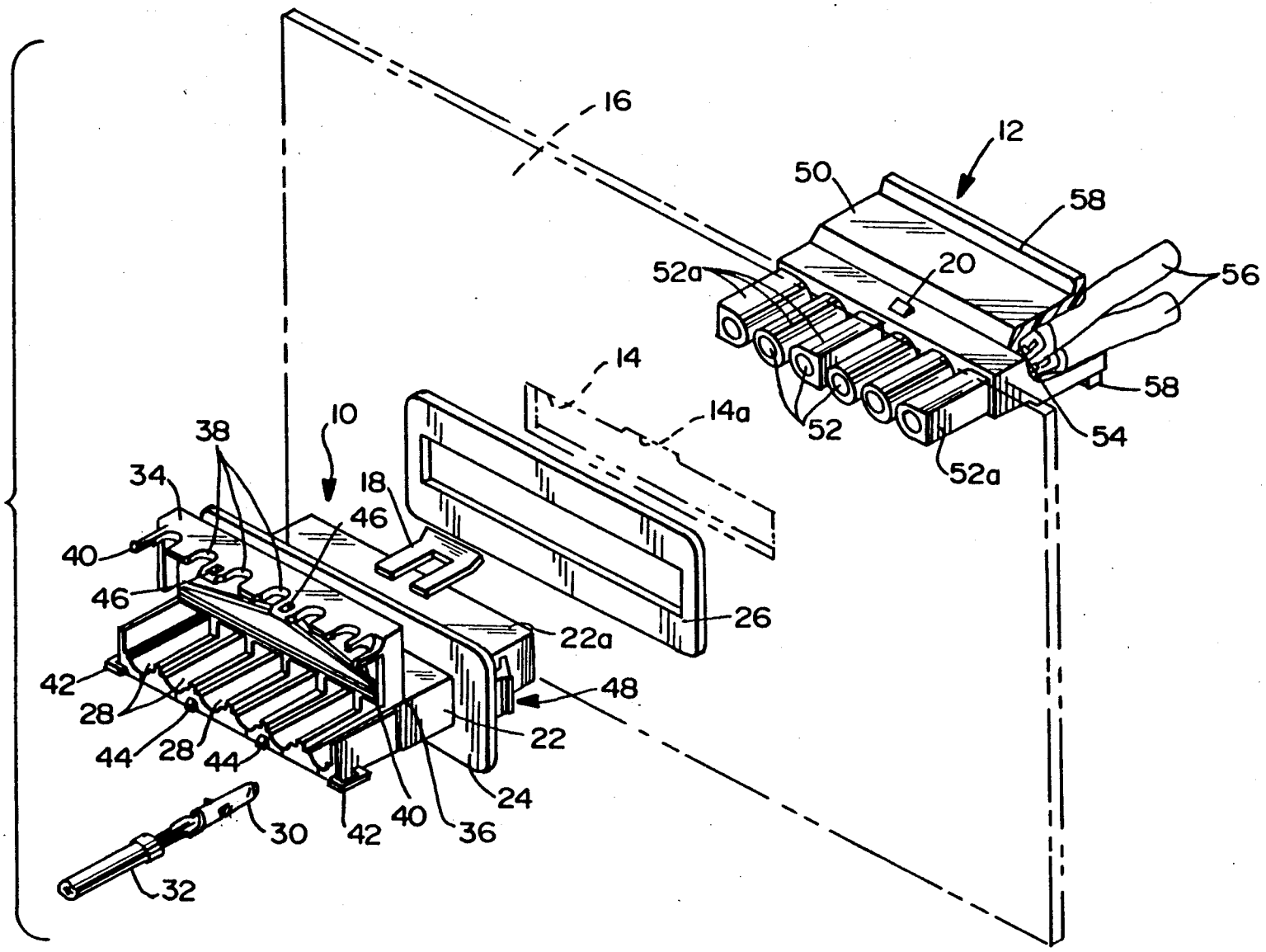
FIG. 1 is an exploded perspective view of a connector assembly for mounting through an opening in a panel, the plug connector in the opening including the novel latch means of the invention.

Referring to the drawings in greater detail, and first to FIG. 1, the invention is incorporated in an electrical connector assembly which includes a plug connector, generally designated 10, and a receptacle connector, generally designated 12. The connectors are designed for mating through an opening 14 in a panel 16, shown in phantom. The opening has a notch 14*a* in the upper edge thereof for accommodating a lock arm 18 on the top of plug connector 10 which engages a lock detent 20 on the top of receptacle connector 12 when the connectors are mated.

Plug connector 10 includes a housing 22 having a forward portion 22*a* insertable through opening 14. A peripheral flange 24 sandwiches a gasket 26 between the flange and the "inside" face of panel 16 when connector 10 is inserted through opening 14 to seal the connector to the panel about the opening. Plug connector housing 22 has a plurality of troughs 28 for receiving a plurality of male terminals 30 (only one of which is shown in FIG. 1) which are crimped and terminated to respective electrical wires 32. The male terminals are inserted into troughs 28 so that they extend into forward portion 22*a* of the housing. A hinged cover 34 is joined to housing 22 by integral living hinge portions 36, the cover having notches 38 in registry with troughs 28 to engage about the insulation surrounding wires 32 to seal the interior of the housing. Hinged cover 34 has side lock hooks 40 for engaging side lock eyelets 42 on housing 22 to secure the hinged cover in sealing engagement about insulated wires 32. A pair of front lock nibs 44 also are provided on housing 22 for engaging in lock holes 46 in hinged cover 34 to further insure sealing about insulated wires 32. Lastly, a pair of latch arms (only one being visible in FIG. 1), generally designated 48, are provided on front portion 22*a* of housing 20 for latching within opening 14 in panel 16, as described in greater detail hereinafter, and incorporating the novel means for accommodating panels of different thicknesses.

Receptacle connector 12 includes a housing 50 having the aforementioned lock detents 20 thereon, and including forwardly projecting cylinders 52 for receiving female terminals 54 in a known fashion. The female terminals are terminated to insulated electrical wires 56 and, in some instances, may be terminated to double wire configurations as shown in FIG. 1. Top and bottom pull flanges 58 are provided on housing 50 to facilitate manual manipulation thereof. Some of the cylinders, identified as 52*a*, are flattened on given sides thereof to provide polarizing capabilities. When plug connector 10 is latched within opening 14 in panel 16, receptacle connector 12 can be inserted into connector 10 with cylinders 52, 52*a* being inserted into the forward portion 22*a* of housing 22 of connector 10, whereby male terminals 30 enter cylinders 52, 52*a* for mating with female terminals 54. It should be understood that, although connector 12 actually is "plugged into" connector 10, connector 10 is called a plug connector and connector 12 is called a receptacle connector herein because male terminals 30 within connector 10 are received in female terminals 54 in connector 12.

Figure 2:
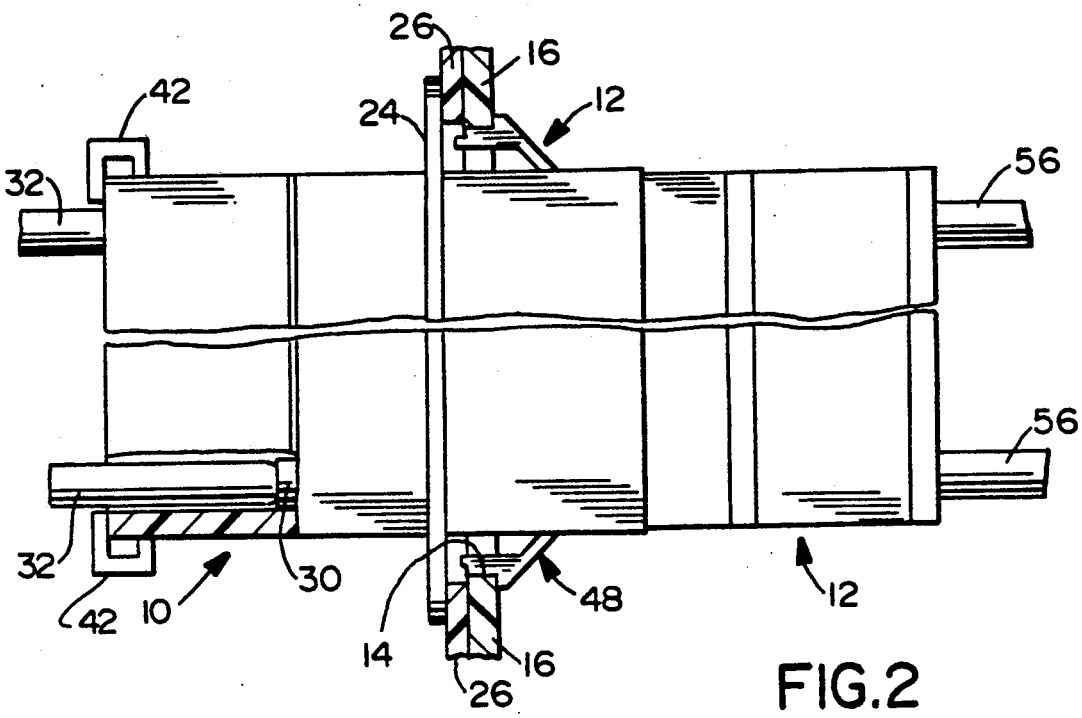
FIG. 2 is a horizontal section, partially cut away, of the connector assembly mounted in the panel opening.

Referring to FIG. 2, the plug connector described above in relation to FIG. 1, is shown in mated condition through opening 14 in panel 16. It can be seen that flange 24 on connector 10 sandwiches sealing gasket 26 between the flange and the panel about the panel opening. It also can be seen that latch arms 48 are in abutting engagement with the outside surface of panel 16 to securely hold connector 10 in the opening in the panel.

Figure 3:
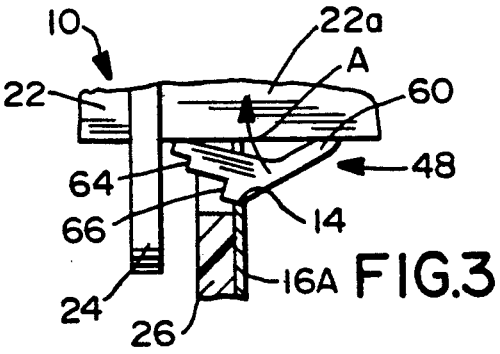
FIG. 3 is a fragmented view of the latch means in position as being inserted through the panel opening, with the panel being of a first thickness.
Figure 4:
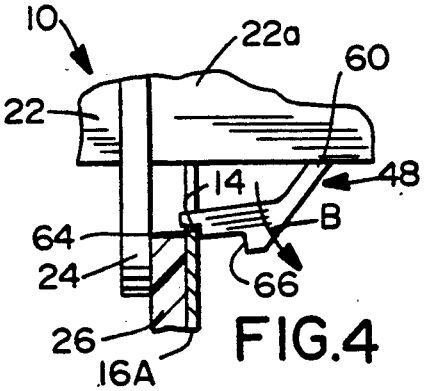
FIG. 4 is a view similar to that of FIG. 3, with the latch means latchably engaging the panel at the edge of the opening therein.
Figure 5:
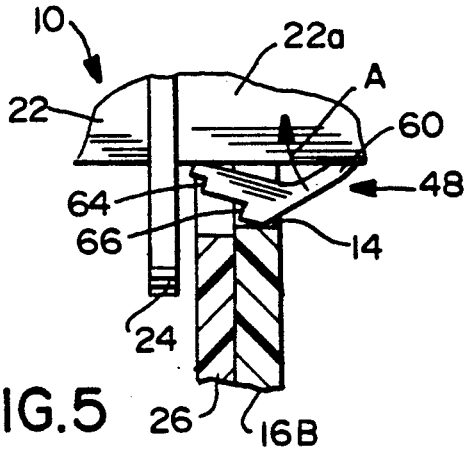
FIG. 5 is a view similar to that of FIG. 3, but with a panel of a second or greater thickness.
Figure 6:
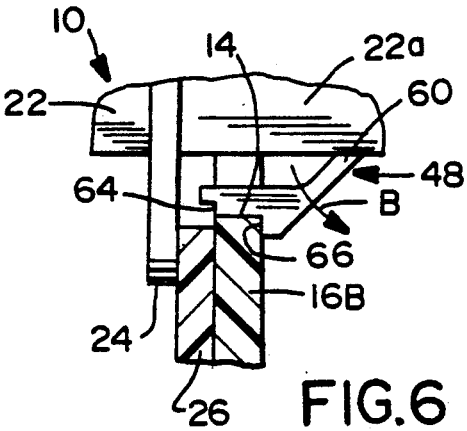
FIG. 6 is a view similar to that of FIG. 5, with the latch means latchably engaging the thicker panel.

Referring to FIGS. 3–6 in conjunction with FIG. 2, one of the latch arms 48 will be described in greater detail, with the understanding that both latch arms 48 are constructed and function the same. Before proceeding, it would be helpful to understand that FIGS. 3 and 4 show the latch arm and connector 10 in operative association with a panel 16A which is of a rather narrow thickness, and FIGS. 5 and 6 show the latch arm and connector in operative association with a panel 16B of thicker dimensions. The latch arms are constructed to accommodate different thicknesses of panels as shown in these figures.

More particularly, each latch arm 48 is molded integral with connector housing 22, i.e., the forward portion 22*a* of the housing, the housing itself being molded of appropriate dielectric material. The latch arm is connected to the housing by a "living hinge" 60 so as to be cantilevered outwardly from the housing when in a normal or unstressed condition. In other words, the hinge means for each latch arm 48 is provided by the continuous molded material which is afforded by joining the latch arm to the housing in an integral molding process.

The opening 14 in whatever thickness of panel 16, 16A and 16B is contemplated, is sufficiently oversized to allow for latch arms 48 to pass therethrough as shown in FIGS. 3 and 5. Of course, the corresponding opening in gasket 26 is similarly oversized, and abutment flange 24 about the periphery of housing 22 of connector 10 is sufficiently large to abut against the gasket about the opening therein and the opening in the respective panel. As the connector is inserted into the opening, the latch arms are cammed inwardly in the direction of arrows "A" (FIGS. 3 and 5).

Once connector 10 is inserted to its proper mating position into opening 14 in the respective panel whereby flange 24 abuts against and slightly compresses gasket 26, it can be seen that latch arms 46 snap outwardly in the direction of arrows "B" as shown in FIGS. 4 and 6. When inserting the connector through the panel opening, it can be understood that gasket 26 is fabricated of a somewhat resilient material in order to provide good sealing characteristics. In addition, with latch arms 48 being fabricated of molded dielectric material, such as plastic or the like, the latch arms themselves have some resiliency. Consequently, when the connector is in its latched condition as shown in FIGS. 4 and 6, opposing forces are provided to securely latch the connector within the panel opening.

As discussed on occasion above, cantilevered latch arms 48 are provided with novel means for accommodating panels of different thicknesses at opening 14 in the respective panels, such as the thin panel 16A shown in FIGS. 3 and 4 and the thicker panel 16B shown in FIGS. 5 and 6. More particularly, this means is provided by a stepped configuration formed in the outside surfaces of the latch arms. In the embodiment of the invention shown in the drawings, the latch arms can accommodate panels of two different thicknesses as afforded by steps 64 and 66 integrally molded into the outside surfaces of the latch arms. It can be seen that step 64 is closer to flange 24 of the connector than is step 66. In other words, the distance between step 64 and flange 24 is less than the distance between step 66 and the flange. Consequently, step 64 will snap behind a panel of a lesser thickness than step 66. This is shown by the depictions in FIGS. 3–6 wherein step 64 snaps behind thinner panel 16A in FIGS. 3 and 4, and step 66 snaps behind thicker panel 16B in FIGS. 5 and 6.

It should be understood that FIGS. 3–6 represent examples of the novel concept of the invention and should not be considered limiting. For instance, it readily can be understood that latch arms 48 can be made longer simply by changing the location of living hinge 60 in a forward direction, and that more than two steps 64, 66 could be provided for accommodating more than just two thicknesses of panels. In addition, the distances between the steps and flange 24 have been calculated to include a gasket such as gasket 26. If no gasket is used with a thicker panel 16B, flange 24 would directly engage the panel.

From the foregoing, it can be seen that a panel mounted connector 10 has been provided with a novel latching system in the form of latch arms 48 which are integral with the housing of the connector to accommodate panels of varying thicknesses. Therefore, separate, less cost effective latching mechanisms are not necessary. It can be understood that a single or common connector construction can be manufactured and used with panels of different thicknesses, thereby avoiding any necessity of maintaining an inventory of different connectors having different configurations of latching means. For instance, in the application example described in the Background, above, a small appliance may have a relatively thin sheet metal panel whereby a much larger appliance may require a relatively thicker panel. In the dimensions shown in the drawings, in actual practice, with the connector dimensions and gasket 26 dimensions remaining constant, step 64 on each latch arm 48 is located for accommodating a panel on the order of 0.018 inch thick, and step 66 is located to accommodate a panel on the order of 0.079 inch thick.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical connector for mounting in an opening in a panel or the like, comprising:

a housing having a forward portion positionable in the opening in the panel and including a peripheral flange about the housing for sealing against resilient gasket means on one side of the panel about the opening therein;

a pair of latch arms on opposite sides of the housing for engaging the panel at an edge of the opening for securing the housing in the opening, the latch arms including means for accommodating panels of different thicknesses at the opening and means for biasing the latch arms outwardly of the housing; and said housing having a rearward portion having a plurality of troughs extending into and through said forward portion into which terminals connected to insulated wires are insertable and upwardly extending sidewalls on each side of said plurality of troughs, and a hinged cover having notches in registry with said troughs to engage about insulation of said wires and downwardly extending sidewalls to slidably engage with said upwardly extending sidewalls;

whereby said flange being forced against said resilient gasket means by said latch arms, and said hinged cover with its notches and sidewalls engaging said housing with its troughs, sidewalls, and the inserted insulated wires, seals the rearward portion of said housing.

2. The electrical connector of claim 1 wherein said hinged cover has side lock hooks for engaging side lock eyelets on said housing to secure the hinged cover in sealing engagement about said insulated wires.

* * * * *